US009377275B2

(12) United States Patent
DeGreef, III

(10) Patent No.: US 9,377,275 B2
(45) Date of Patent: Jun. 28, 2016

(54) ARMOR PLATED DEVICE

(71) Applicants: Roger Degreef, Washington Township, MI (US); David Robinson, Warren, MI (US)

(72) Inventor: Roger DeGreef, III, Washington Township, MI (US)

(73) Assignees: Roger Degreef, Washington Township, MI (US); David Robinson, Warren, MI (US)

( * ) Notice: Subject to any disclaimer, the term of this patent is extended or adjusted under 35 U.S.C. 154(b) by 0 days.

(21) Appl. No.: 14/321,909

(22) Filed: Jul. 2, 2014

(65) Prior Publication Data

US 2015/0292839 A1 Oct. 15, 2015

Related U.S. Application Data

(62) Division of application No. 13/783,659, filed on Mar. 4, 2013, now abandoned, which is a division of application No. 11/858,003, filed on Sep. 19, 2007, now Pat. No. 8,402,875.

(51) Int. Cl.
*F41H 5/16* (2006.01)
*F41H 5/06* (2006.01)
(Continued)

(52) U.S. Cl.
CPC .. *F41H 5/06* (2013.01); *F41H 5/02* (2013.01); *F41H 5/0492* (2013.01); *F41H 5/16* (2013.01)

(58) Field of Classification Search
CPC ..... F41H 7/044; F41H 7/048; F41H 5/16
USPC ..... 89/36.02
See application file for complete search history.

(56) References Cited

U.S. PATENT DOCUMENTS 1,296,421 A 3/1919 Miller et al.
1,706,387 A 3/1929 Kramer
(Continued)

FOREIGN PATENT DOCUMENTS

EP 041271 * 12/1981
WO 98/04781 A1 2/1998
(Continued)

OTHER PUBLICATIONS

Publication entitled "Multiple Challenges . . . One Versatile Solution" reprinted from: Geocell Systems Inc., Suite 202, Pier 54, Terry Francois Blvd., San Francisco, CA 94107 (info@geocellsystems.com); published in Dec. 14, 2002; by Geocell Systems Inc.
(Continued)

*Primary Examiner* — Stephen M Johnson
(74) *Attorney, Agent, or Firm* — Howard & Howard Attorneys PLLC

(57) ABSTRACT

An armor plated assembly (20) and a protective wall system (120) containing a protective material. The armor plated assembly (20) comprises of a container (22) having opposing walls (26) for encompassing the protective material. The assembly (20) includes an armor device (24) having a first plate (48) and a second plate (50) with one of the opposing walls (26) sandwiched between the first plate (48) and the second plate (50) securing the armor device (24) to the container (22). The armor device (24) impedes the penetration of a projectile through the armor plated assembly (20). The protective wall system (120) includes at least two of the armor plated assemblies (20) with a mechanical connection (140) between the armor devices (126, 134) of the armor plated assemblies (20) for aligning and securing the assemblies (20) in a stacked orientation. A second embodiment of the protective wall system (220) includes at least two containers (222, 234) and a bib (232, 236) adhered to each of the containers (222, 234) such that the bibs (232, 236) overlap in a shingle-like engagement between the stacked containers (222, 234).

16 Claims, 10 Drawing Sheets

(51) Int. Cl.
*F41H 5/04* (2006.01)
*F41H 5/02* (2006.01)

(56) References Cited

U.S. PATENT DOCUMENTS

| | | | | |
|---|---|---|---|---|
| 1,777,926 | A | | 10/1930 | Lillard |
| 3,172,267 | A | | 3/1965 | Fisher |
| 3,228,361 | A | | 1/1966 | Ritter |
| 3,374,635 | A | | 3/1968 | Crandall |
| 3,545,155 | A | | 12/1970 | Church |
| 3,784,085 | A | | 1/1974 | Kilgore |
| 3,820,294 | A | | 6/1974 | Parker |
| 3,856,268 | A | | 12/1974 | Fitch |
| 3,886,751 | A | | 6/1975 | Labora |
| 3,890,802 | A | | 6/1975 | Auriat |
| 3,922,832 | A | | 12/1975 | Dicker |
| 4,294,405 | A | | 10/1981 | Ross |
| 4,362,433 | A | | 12/1982 | Wagner et al. |
| 4,423,854 | A | | 1/1984 | Cobb et al. |
| 4,449,847 | A | | 5/1984 | Scales et al. |
| 4,545,286 | A | | 10/1985 | Fedij |
| 4,578,814 | A | | 3/1986 | Skamser |
| 4,650,368 | A | | 3/1987 | Bayer |
| 4,662,794 | A | | 5/1987 | Delmas et al. |
| 4,723,742 | A | | 2/1988 | Krauss |
| 4,784,520 | A | | 11/1988 | Stevens |
| 4,963,037 | A | | 10/1990 | Manerba |
| 5,031,733 | A | | 7/1991 | Chang |
| 5,086,888 | A | | 2/1992 | Chu |
| 5,149,203 | A | | 9/1992 | Sacks |
| 5,241,783 | A | | 9/1993 | Krueger |
| 5,584,599 | A | | 12/1996 | Knittel |
| 5,605,232 | A | | 2/1997 | Bickle |
| D382,349 | S | | 8/1997 | Hinton |
| 5,669,732 | A | | 9/1997 | Truitt |
| 5,670,734 | A | * | 9/1997 | Middione et al. ..... 89/36.08 |
| 5,678,358 | A | | 10/1997 | Koledin |
| D393,322 | S | | 4/1998 | Suttles |
| 5,792,974 | A | | 8/1998 | Daqis et al. |
| 5,797,140 | A | | 8/1998 | Davis et al. |
| 5,829,653 | A | | 11/1998 | Kaiser |
| 5,829,915 | A | | 11/1998 | Andreassen |
| 5,934,027 | A | | 8/1999 | Khalili |
| 5,957,172 | A | | 9/1999 | DeGreef et al. |
| 6,012,872 | A | | 1/2000 | Perry et al. |
| 6,161,738 | A | | 12/2000 | Norris |
| 6,390,154 | B1 | | 5/2002 | Hall |
| 6,419,132 | B1 | | 7/2002 | Reed et al. |
| 6,428,240 | B1 | | 8/2002 | Ehrlich et al. |
| 6,477,934 | B1 | | 11/2002 | Bruhn et al. |
| 6,491,431 | B2 | | 12/2002 | Merten |
| 6,524,670 | B1 | | 2/2003 | Kataoka |
| 6,612,741 | B1 | | 9/2003 | Horne |
| 6,619,884 | B2 | | 9/2003 | Davis et al. |
| 6,681,400 | B1 | | 1/2004 | Mills |
| 6,685,071 | B2 | | 2/2004 | Prather |
| 6,817,806 | B1 | | 11/2004 | Arellanes |
| 6,843,616 | B2 | | 1/2005 | Sychra |
| 6,874,401 | B2 | | 4/2005 | Bishop et al. |
| 7,765,744 | B2 | | 8/2010 | Herron |
| 8,402,875 | B2 | | 3/2013 | DeGreef |
| 2002/0090265 | A1 | | 7/2002 | Merten |
| 2002/0106245 | A1 | | 8/2002 | Ehrlich et al. |
| 2002/0164210 | A1 | | 11/2002 | Davis et al. |
| 2002/0168227 | A1 | | 11/2002 | Rubin |
| 2003/0035689 | A1 | | 2/2003 | Metz |
| 2003/0145530 | A1 | | 8/2003 | James |
| 2004/0047689 | A1 | | 3/2004 | Davis et al. |
| 2004/0052583 | A1 | | 3/2004 | Davis et al. |
| 2004/0091181 | A1 | | 5/2004 | James |
| 2004/0096275 | A1 | | 5/2004 | Rorheim |
| 2004/0200339 | A1 | | 10/2004 | Bishop et al. |
| 2005/0005566 | A1 | | 1/2005 | Kim |
| 2005/0011347 | A1 | | 1/2005 | Muller |
| 2005/0045504 | A1 | | 3/2005 | Tan |
| 2005/0123221 | A1 | | 6/2005 | Wang |
| 2005/0169712 | A1 | | 8/2005 | Young |
| 2007/0234895 | A1 | * | 10/2007 | Singh et al. ..... 89/36.07 |
| 2008/0197756 | A1 | | 8/2008 | Macias et al. |

FOREIGN PATENT DOCUMENTS

| | | | |
|---|---|---|---|
| WO | 99/42667 | A1 | 8/1999 |
| WO | 02/033221 | A2 | 4/2002 |
| WO | 2005/007598 | A2 | 1/2005 |
| WO | 2005/047807 | A2 | 5/2005 |
| WO | 2005/100903 | A1 | 10/2005 |

OTHER PUBLICATIONS

Publication entitled "Introducing The Rapid Deployment Flood Wall" reprinted from: Geocell Systems Inc., (http://www.geocell-systems.com/rdfw/index.htm); published in Jul. 15, 2005; by Geocell Systems Inc.

Publication entitled "FPED V . . . We Had A Blast" reprinted from: Geocell Systems Inc., (http://www.geocell-systems.com/security/RPED_5/; published in Apr. 29, 2005; by Geocell Systems Inc.

Publication entitled "RDFW Survives 40 Pounds of C-4 . . . TWICE!" reprinted from: Geocell Systems Inc., http://www.geocell-systems.com/security/Bakersfield/; published in Nov. 7, 2005; By Geocell Systems, Inc.

Publication entitled "Modular Versatile Force Protection" reprinted from: Geocell Systems Inc., Pier 54, Terry Francois Blvd., Suite 202, San Francisco, CA 94107 info@geocellsystems.com; published in Aug. 12, 2003; by Geocell Systems Inc.

Publication entitled Joint Expeditionary Field Fortification: reprinted from: Marine Corps Warfighting Laboratory, Public Affairs Office, 3255 Meyers avenue, Quantico, VA 22134; (www.mcwl.quantico.usmc.mil); published in Jun. 2005; by Quantico USMC.

Publication entitled "USAF Builds RDFW Walls in Iraq" reprinted from: Geocell Systems Inc. (http://www.geocell-systems.com/security/Iraq_USAF_1/); published in Aug. 3, 2005; by Geocell systems Inc.

Publication entitled "Force Protection Application for the Rapid Deployment Foritification Wall" reprinted from: Geocell Systems, Inc., Suite 202, Pier 54, Terry Francois Blvd., San Francisco, CA 94107 (info@geocellsystems.com) (GSA #GS-07F-0340M), published in Jul. 2002; by Geocell Systems Inc.

Publication entitled "Titanium Armor Plating For Armored Vehicles" reprinted from: ATI Wah Chang Allegheny Technologies (http://www.army-technology.com/company_printable.asp?ProductSubG . . . ); by ATI Wah Chang Allegheny Tecnologies; accessed Oct. 15, 2007.

Publication entitled "RDFW Bagging Sandbags" reprinted from: Eastman Innovation Lab (http://www.inovationlab.eastman.com/InnovationLab/Inspir . . . ); by Eastman Innovation Lab; accessed Feb. 20, 2006.

* cited by examiner

ARMOR PLATED DEVICE

CROSS-REFERENCE TO RELATED APPLICATIONS

The subject patent application is a divisional of U.S. patent application Ser. No. 13/783,659, filed on Mar. 4, 2013, now abandoned, which is a divisional of U.S. patent application Ser. No. 11/858,003, filed on Sep. 19, 2007, now U.S. Pat. No. 8,402,875, the disclosures of which is hereby incorporated by reference.

BACKGROUND OF THE INVENTION

1. Field of the Invention

An armor plated assembly for holding a protective material for impeding the penetration of a projectile.

2. Description of the Prior Art

A plurality of sandbags are often used to erect a wall for protection of personnel, i.e., people, and property. For example, the sandbags are often stacked to erect the wall, such as a dam or a dike, during a flood. The wall diverts water, thereby protecting people and property during the flood. The sandbags are also often used to deflect and absorb projectiles, e.g., bullets and shrapnel. For example, the sandbags are often used to erect fortifications, such as bunkers, to protect military personnel from bullets, explosions, and weather conditions. In addition, the sandbags are also used to protect vehicles, such as tanks and personnel carriers.

As known to those skilled in the art, the sandbags are typically filled with sand and are sealed to retain the sand therein. The sandbag is usually formed from burlap or a similar flexible material. However, the sandbags are prone to weathering, such as dry-rot, when exposed to UV rays, i.e., the sun, and water. In addition, the sandbags also rip and tear easily, especially when projectiles contact and pierce the sandbags and during movement and placement of the sandbags. When the sandbags are ripped or torn, the sandbags break down and quickly lose their effectiveness in stopping or slowing projectiles. This often occurs when the sandbags are pierced and sand leaks from the sandbags. In addition, the sandbags rely upon sand to absorb a majority of the force exerted by projectiles because the sandbags themselves are easily penetrated due to the material the sandbags are formed from.

Accordingly, there remains an opportunity to provide a sandbag with increased strength for protection of personnel and property. In addition, there remains an opportunity to provide a sandbag with increased locating, placing and fixing flexibility, such as when erecting a wall with a plurality of the sandbags.

SUMMARY OF THE INVENTION AND ADVANTAGES

An armor plated assembly containing a protective material. The armor plated assembly comprises of a container having opposing walls defining an envelope. A portion of the envelope is movable between an open position for receiving the protective material and a closed position for encompassing the protective material. The armor plated assembly includes an armor device at least partially disposed within the container. The armor device includes a first plate and a second plate with at least one of the opposing walls being sandwiched between the first plate and the second plate for securing the armor device to the container. The armor device impedes the penetration of a projectile through the armor plated assembly.

In another aspect the subject invention also provides for a protective wall system for protecting against the penetration of the projectile. The protective wall system includes a plurality of the above described armor plated assemblies. The protective wall system includes a first container having a first armor device partially disposed on the first container. The protective wall system includes a second container and a second armor device partially disposed on the second container. The first armor device includes a first outer plate and a first inner plate. The second armor device includes a second outer plate and a second inner plate. A mechanical connection is disposed between the first and second outer plates. The mechanical connection aligns the first and second armor devices and the first and second containers to define the protective wall system.

In another aspect the subject invention also provides for an alternative protective wall system for protecting against the penetration of the projectile. The alternative protective wall system comprises of a first container having a top, a bottom, two opposing side and a base. The first container defines an envelope with a portion of the envelope movable between an open position for receiving a protective material and a closed position for encompassing the protective material. A first bib is attached to the top of the first container and the first bib extends over one of the opposing sides of the first container. The alternative protective wall system includes a second container having a top, a bottom, two opposing side and a base. The second container defines an envelope with a portion of the envelope movable between an open position for receiving the protective material and a closed position for encompassing the protective material. A second bib is attached to the top of the second container and extends over one of the opposing side of the second container. The first bib overlaps the second bib in a shingle-like engagement for impeding the penetration of a projectile through the protective wall system.

Accordingly, the subject invention addresses the durability concern of the prior art sandbags by providing an armor plate or a protective bib for impeding the penetration of a projectile through the containers, as well as providing for a mechanical connection to align the assemblies to erect a wall or a structure.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
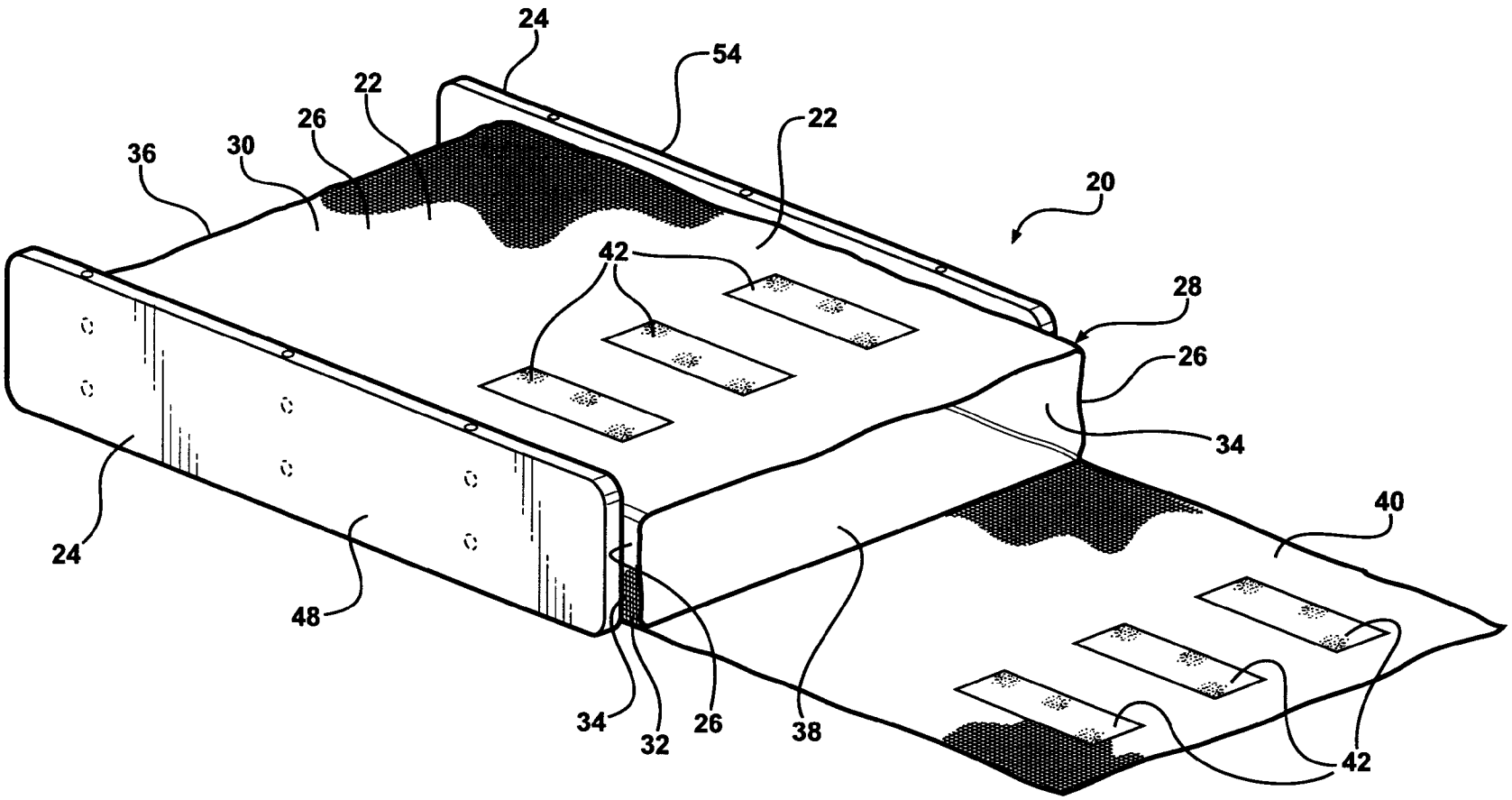
FIG. 1 is a perspective view of an armor plated assembly.

Referring to the Figures, wherein like numerals indicate corresponding parts throughout the several views, an armor plated assembly containing a protective material is shown at 20 in the Figures. The armor plated assembly 20 includes a container 22 and armor device 24 for stopping a projectile from penetrating into and through the armor plated assembly 20. The container 22 may be any suitable size and shape. As shown in FIGS. 1 through 4, the container 22 has opposing walls 26 that define an envelope 28. A portion of the envelope 28 is movable between an open position for receiving the protective material and a closed position for encompassing the protective material. In the illustrated embodiment the opposing walls 26 of the container 22 are defined as a top 30, a bottom 32 and two opposing sides 34. The two opposing side 34 are connected by the top 30 and the bottom 32.

Figure 2:
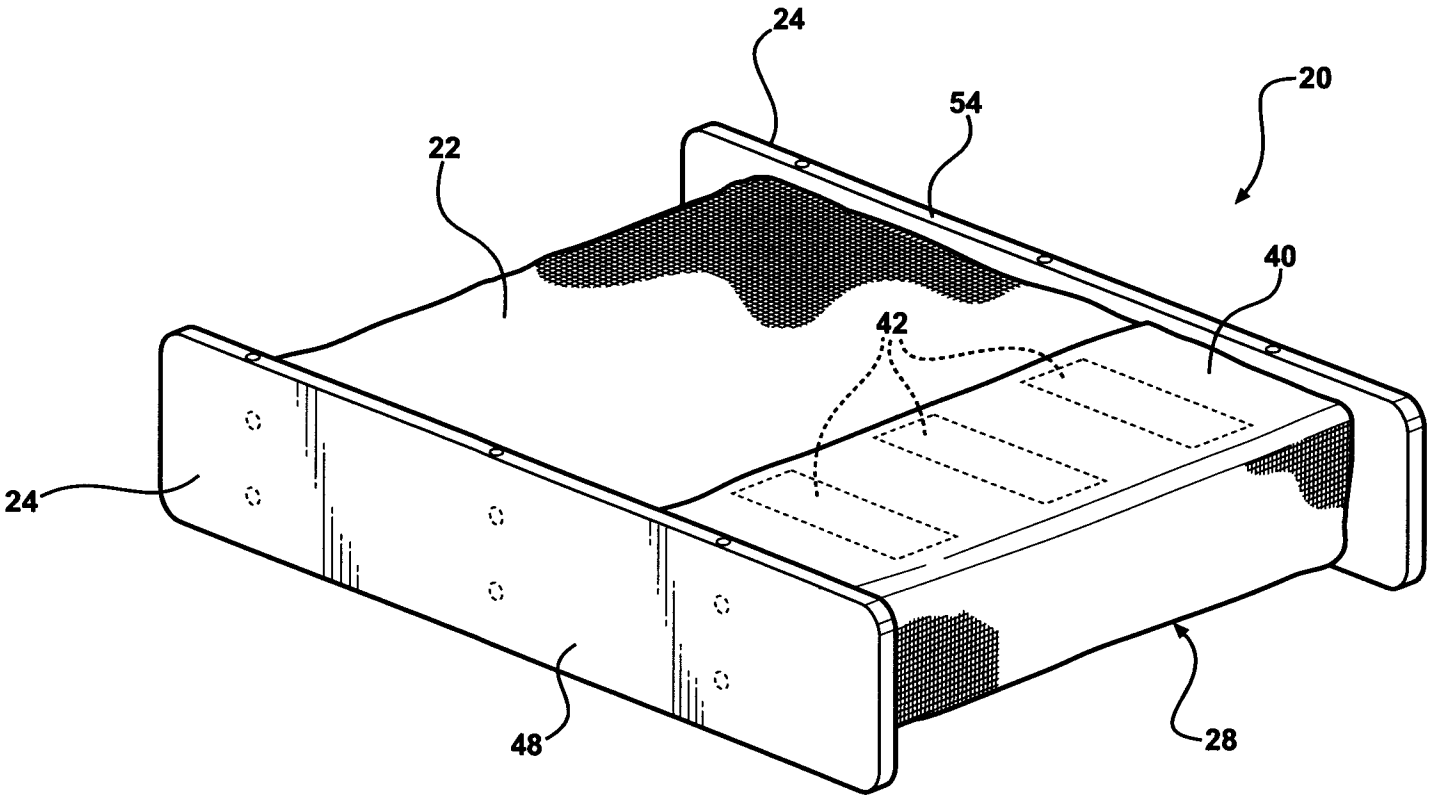
FIG. 2 is a perspective view of the armor plated assembly with a cover flap in a closed position for encompassing a protective material in the container.

The two opposing sides 34 each have a first and a second distal ends. A rounded base 36 at the first distal end extends between the top 30, bottom 32 and the two opposing sides 34 to form the envelope 28 or bag structure. The second distal end defines an opening 38 into the envelope 28 of the container 22. The container 22 also includes a cover flap 40 extending from either the top 30 or the bottom 32. A cover fastener 42 may be located on the cover flap 40 to engage either the top 30 or the bottom 32 to secure the cover flap 40 in a closed position for encompassing the protective material in the container 22, as shown in FIG. 2. The cover fastener 42 may be any suitable fastener known in the art and may include a hook and loop fastener, a zipper, a button, a string, a strap, an adhesive, a clasp, a plurality of stitches or a combination thereof. The container 22 may be formed from a suitable material as is known in the art. The material should be resistant to weather conditions, such as UV rays, water and optionally projectiles. For example, the material may be selected from the group of canvases, synthetic fibers, burlaps, textiles, fabrics, composites, polymers, combinations thereof, or other suitable materials as are known to those skilled in the art.

Figure 3:
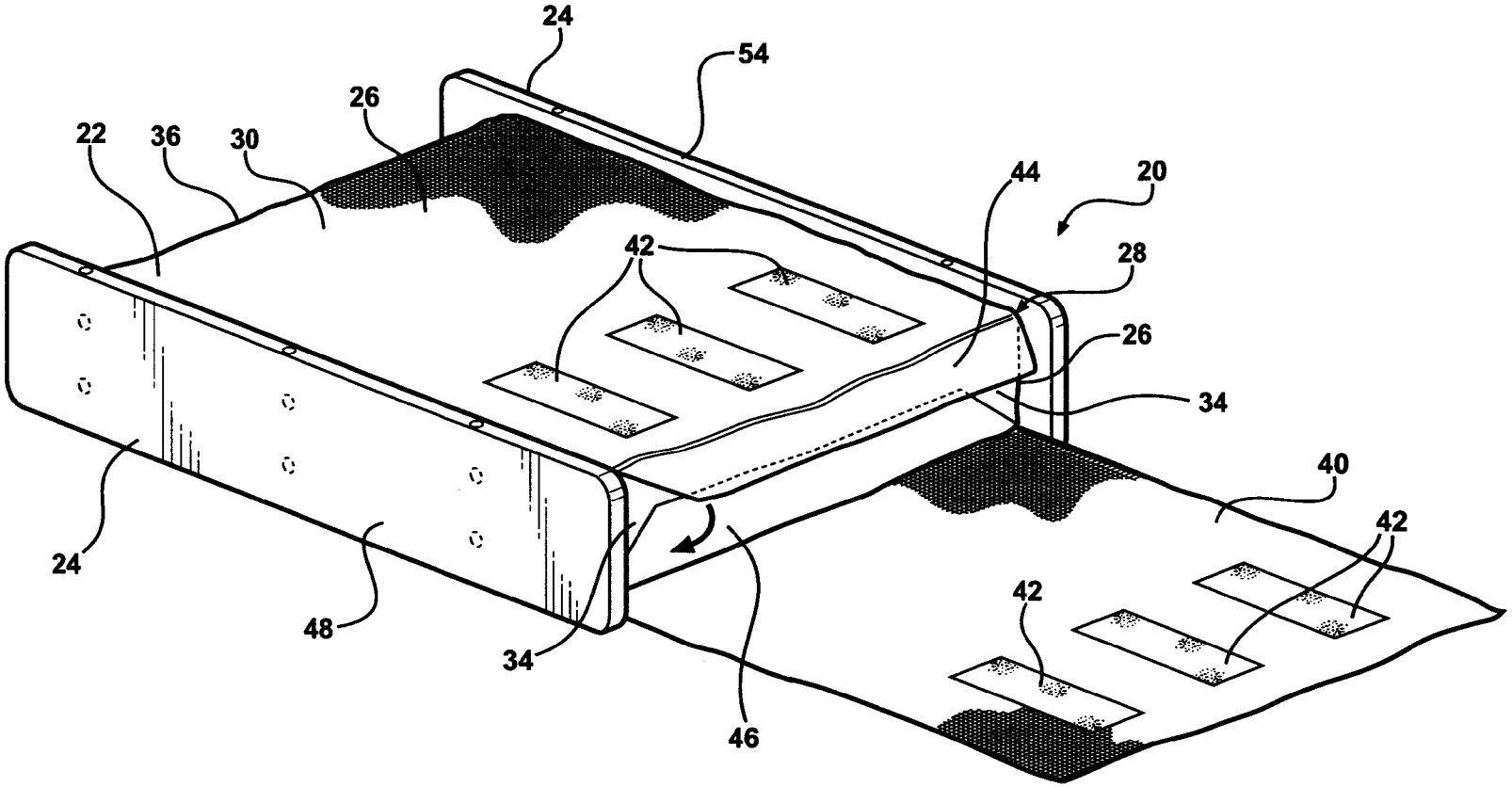
FIG. 3 is a perspective view of the armor plated assembly with additional inner flaps for folding over the opening of a container.

As shown in FIG. 3, the container 22 may additionally include a first inner flap 44 extending from the top 30 and a second inner flap 46 extending from the bottom 32. The inner flaps 44, 46 can be folded over the opening 38 to encompass the protective material in the container 22. The inner flaps 44, 46 are folded as indicated by the arrows in FIG. 3, with the first inner flap 44 being folded first from the opposing sides 34 inward into a trapezoidal shape and secondly folded over the opening 38. The second inner flap 46 is first folded inward from the two sides 34 into a trapezoidal shape and secondly folded over the first flap 44 and the opening 38 as indicated by the arrows closing off the opening 38 of the container 22. The protective material may include any suitable material known in the art. The protective material should be capable of stopping, absorbing, or slowing a projectile, e.g., a bullet, upon impact or entry. Typically, the protective material is filled into the container 22 as a loose bulk or free flowing material, e.g., sand or dirt. The inner flaps 44, 46 are folded over the opening 38 of the container 22 for providing additional protection against leakage of the protective material from the container 22. Since the effectiveness of the armor plated assembly 20 to impede the projectile may be significantly reduced if the protective material leaks from the container 22. The protective material may also be a pre-filled insert, such as a preformed or filled sandbag. The pre-filled insert may include an additional flexible container made of a plastic or similar material as the container 22.

The armor plated assembly 20 includes an armor device 24 at least partially disposed within the container 22. The armor device 24 has a first plate 48 and a second plate 50 with one of the opposing walls 26 sandwiched between the first plate 48 and the second plate 50 for securing the armor device 24 to the container 22. The first and second plates 48, 50 are for additional protection to impede the penetration of a projectile through the armor plated assembly 20. The first plate 48 is attached to the outside of the container 22 on one of the opposing walls 26. The second plate 50 is attached to the container 22 completely encompassed by and inside the container 22. The second plate 50 is aligned on the inside of the container 22 with the first plate 48 on the outside of the container 22 and the opposing wall 26 is between the first and second plates 48, 50 as previously discussed.

Figure 4:
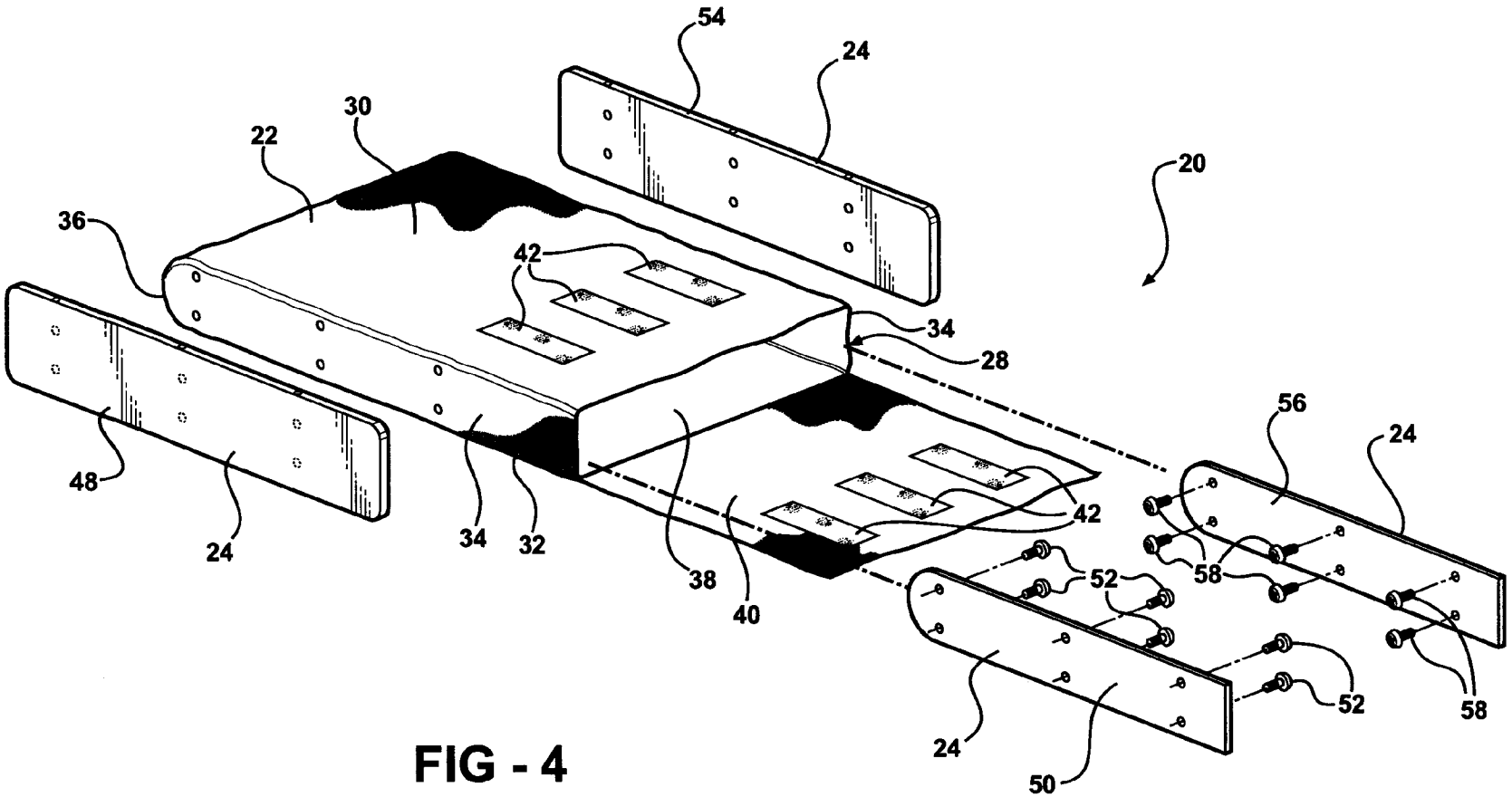
FIG. 4 is an exploded view of the armor plated assembly.
Figure 5:
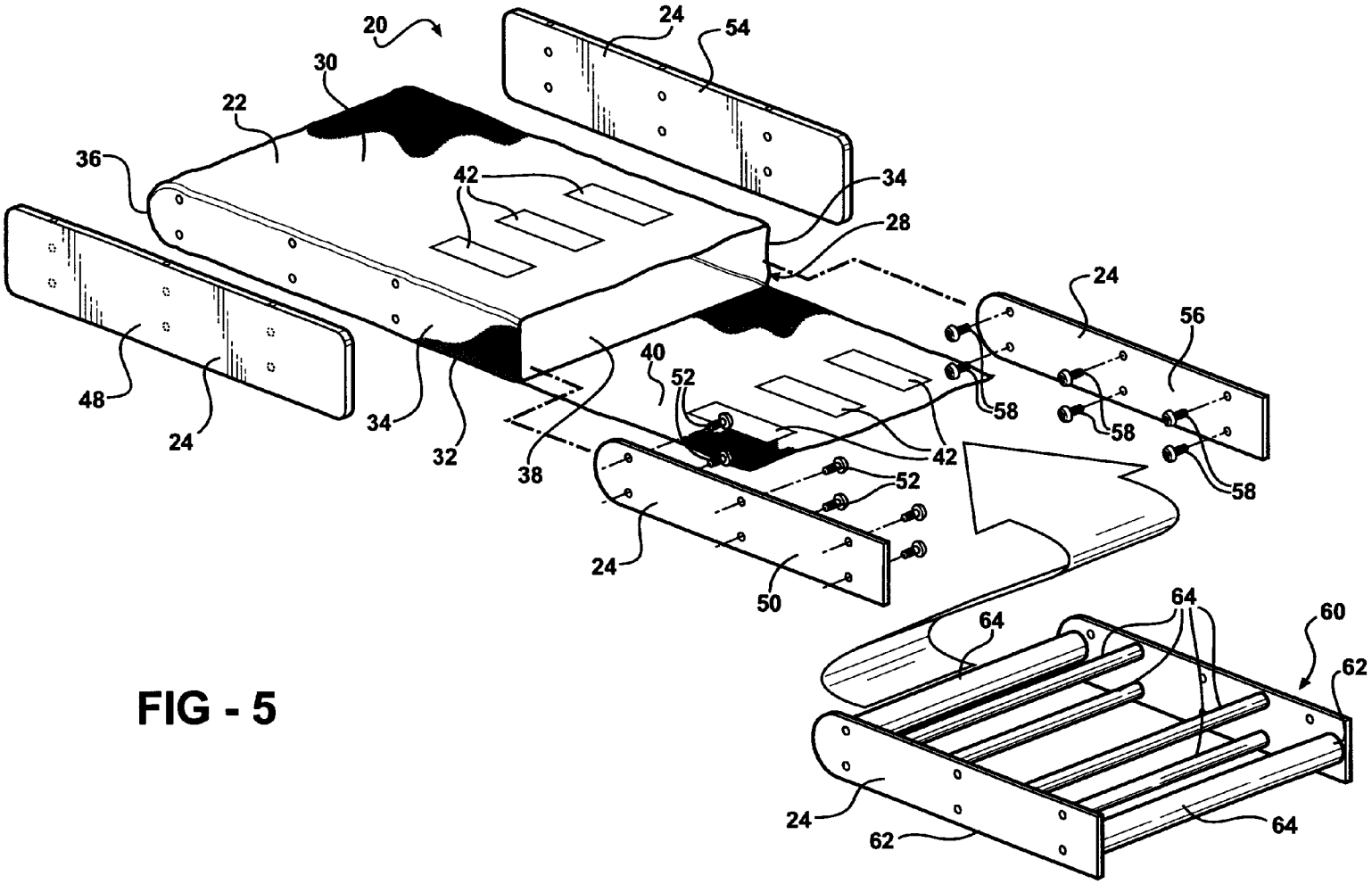
FIG. 5 is an exploded view of the armor plated assembly including an insert apparatus.

The armor device 24 may include at least one first fastener 52 coupled to the first plate 48, the opposing wall 26 and the second plate 50 for securing the first and second plates 48,50 about the opposing wall 26 of the container 22. The first fastener 52 may be selected from the group of rivets, screws, bolts and nuts, combinations thereof, or other fasteners known to those skilled in the art. As shown in FIGS. 4 and 5, the first fastener 52 extents through the second plate 50, the opposing wall 26 and into the first plate 48. The first fastener 52 does not extend through the first plate 48; however, it is appreciated that a nut and bolt or other alternatives known to those skilled in the art may require the first fastener 52 to extend through the first plate 48. It should also be appreciated that the plates 48, 50 may also, or alternatively, be connected by any method or process known in the art. For example, the plates 48, 50 may be pressed, stamped, welded, or adhered, e.g., glued, together.

The armor plated assembly 20 includes scalable protection levels adaptable to protect against various projectiles as required for each given application or environment. The armor device 24 in the illustrated embodiment further includes a third plate 54 and a fourth plate 56. The third and fourth plates 54, 56 are secured to the container 22 with another of the opposing walls 26 sandwiched between the third plate 54 and the fourth plate 56. The additional plates 54, 56 provide additional protection against the penetration of the projectile through the armor plated assembly 20. The third plate 54 is attached to the outside of the container 22 on one of the opposing walls 26. The fourth plate 56 is attached to the container 22 completely encompassed by and inside the container 22. The fourth plate 56 is aligned on the inside of the container 22 with the third plate 54 on the outside of the container 22 and the opposing wall 26 is between the third and fourth plates 54, 56 as previously discussed.

The armor device 24 may include at least one second fastener 58 coupled to the third plate 54, the other opposing wall 26 and the fourth plate 56 for securing the third and fourth plates 54, 56 about the opposing wall 26. The second fastener 58 may be selected from the group of rivets, screws, bolts and nuts, combinations thereof, or other fasteners known to those skilled in the art. As shown in FIGS. 4 and 5, the second fastener 58 extents through the fourth plate 56, the opposing wall 26 and into the third plate 54. The second fastener 58 does not extend through the third plate 54; however, it is appreciated that a nut and bolt or other alternatives known to those skilled in the art may require the second fastener 58 to extend through the third plate 54. It should also be appreciated that the plates 54, 56 may also, or alternatively, be connected by any method or process known in the art. For example, the plates may be pressed, stamped, welded, or adhered, e.g., glued, together.

The plates 48, 50, 54, 56 may be formed from a suitable material as is known in the art. The material should be capable of stopping, absorbing, or slowing a projectile, e.g., a bullet, upon impact. For example, the material may be selected from the group of metals, alloys, plastics, polymers, ceramics, composites, combinations thereof, or other suitable materials as are known to those skilled in the art. As another example, the plates 48, 50, 54, 56 may be formed from titanium, such as Ti-6al-4v, Ti-6al-4v-elv, or combinations thereof. In one embodiment, each one of the plates 48, 50, 54, 56 is formed from the same material, respectively. However, it is appreciated that each plate 48, 50, 54, 56 may be formed of a different material. It should also be appreciated that any combination of materials may be selected for each one of the plates 48, 50, 54, 56 respectively. In addition to providing for material options to provide scalable degrees of protection the thickness of the plates may also vary to accommodate the protection needed for each application.

Optionally, the armor device 24 may include an insert apparatus 60. The insert apparatus 60 is removably disposed within the envelope 28 of the container 22 as shown in FIG. 5. The insert apparatus 60 provides support to the container 22 and spaces the opposing walls 26. The insert apparatus 60 allows for the armor plated assembly 20 to be used in environments or applications where filling the containers 22 with a protective material such as sand or dirt is not preferred. The insert apparatus 60 includes a pair of outer supports 62 spaced a distance apart and supported by at least one rod 64 extending generally perpendicular between the outer supports 62. The outer supports 62 are in contact with the second and fourth plates 50, 56 to support the container 22. In the illustrated embodiment the insert apparatus 60 includes six rods 64 extending between the outer supports 62 to provide additional protection as well as giving the armor plated assembly 20 additional weight to mimic that of the protective material against projectiles.

Figure 6:
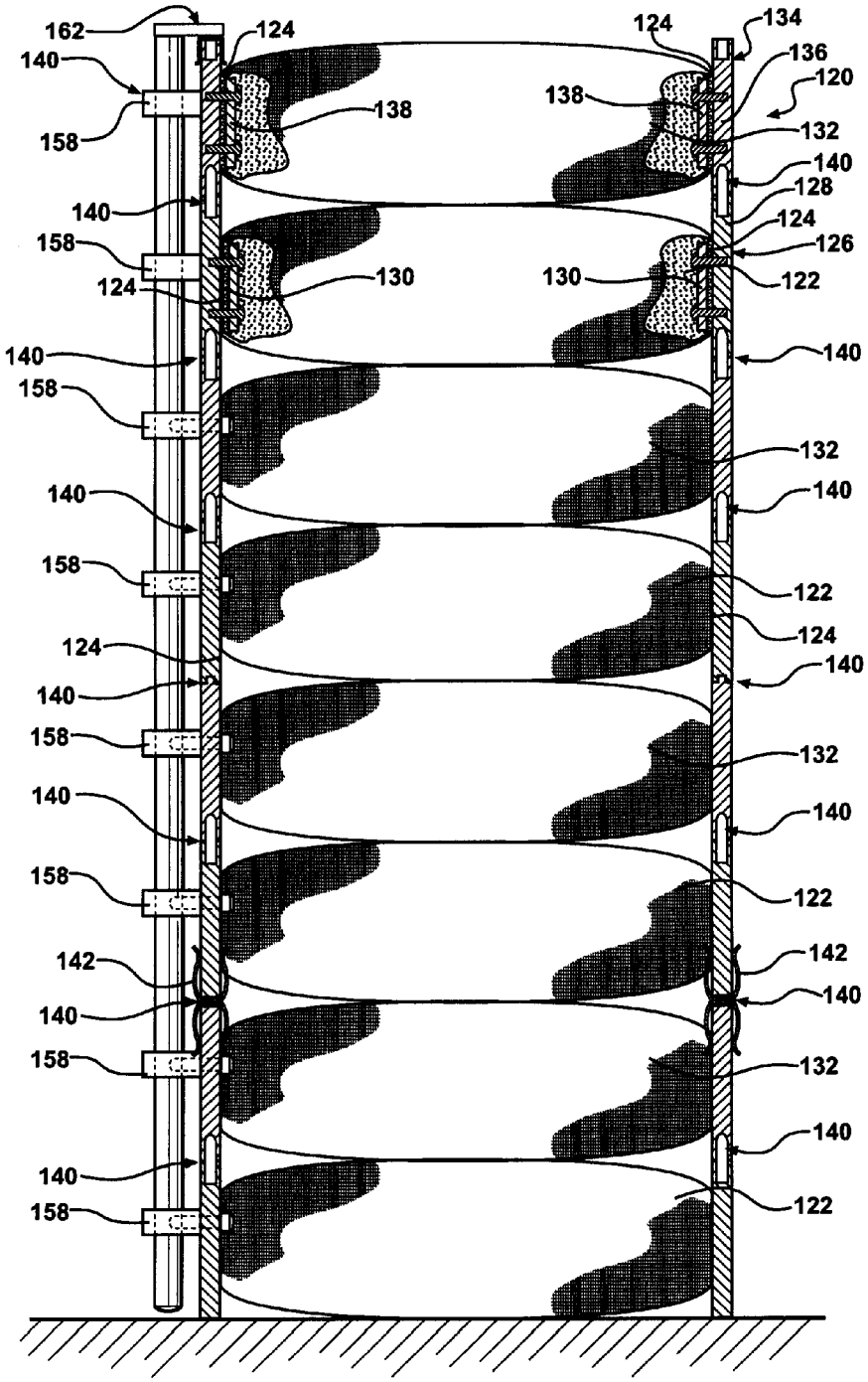
FIG. 6 is a cross-sectional view of a protective wall system including a mechanical connection for aligning and securing the containers in a stacked orientation.
Figure 7A:
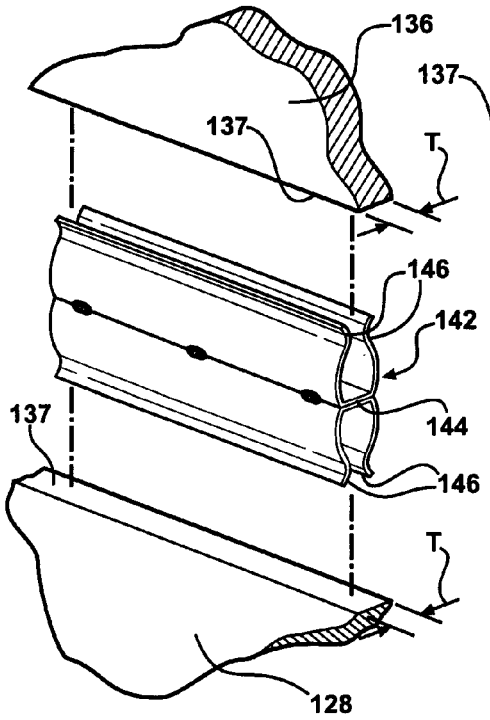
FIG. 7A is a detailed view of a first embodiment of a mechanical connection.
Figure 7B:
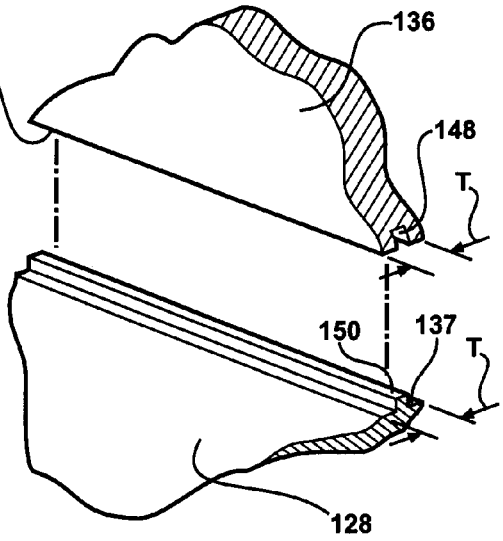
FIG. 7B is a detailed view of a second embodiment of the mechanical connection.
Figure 7C:
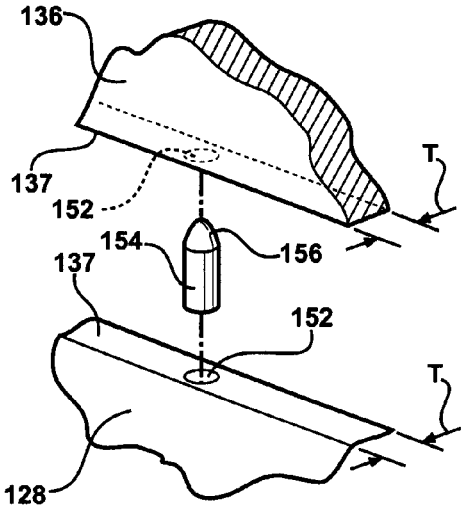
FIG. 7C is a detailed view of a third embodiment of the mechanical connection.
Figure 7D:
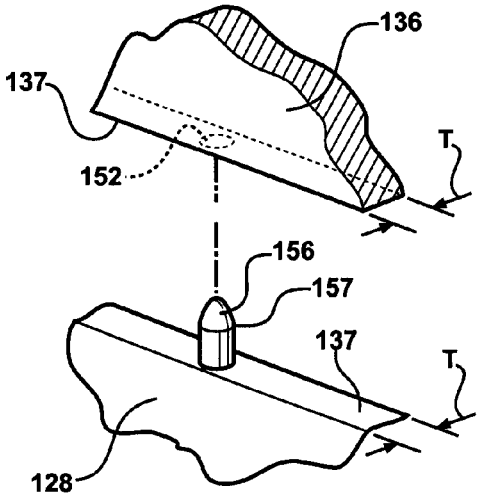
FIG. 7D is a detailed view of a fourth embodiment of the mechanical connection.
Figure 8:
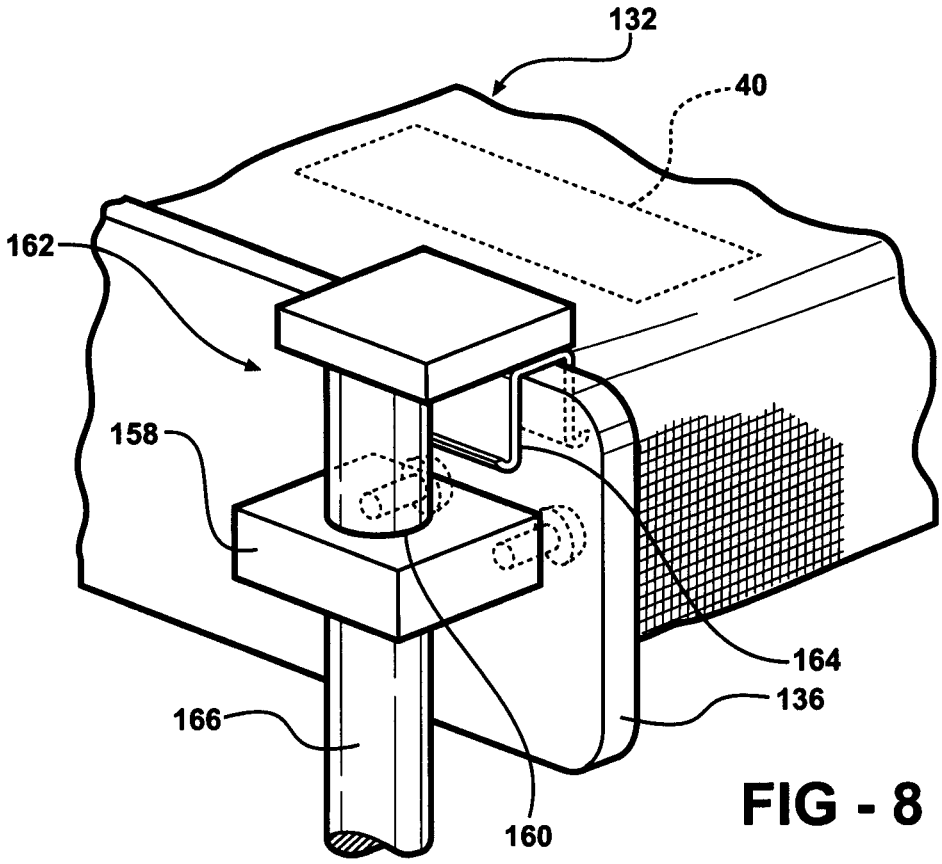
FIG. 8 is a detailed view of a retention apparatus engaging a first plate of the container.
Figure 9:
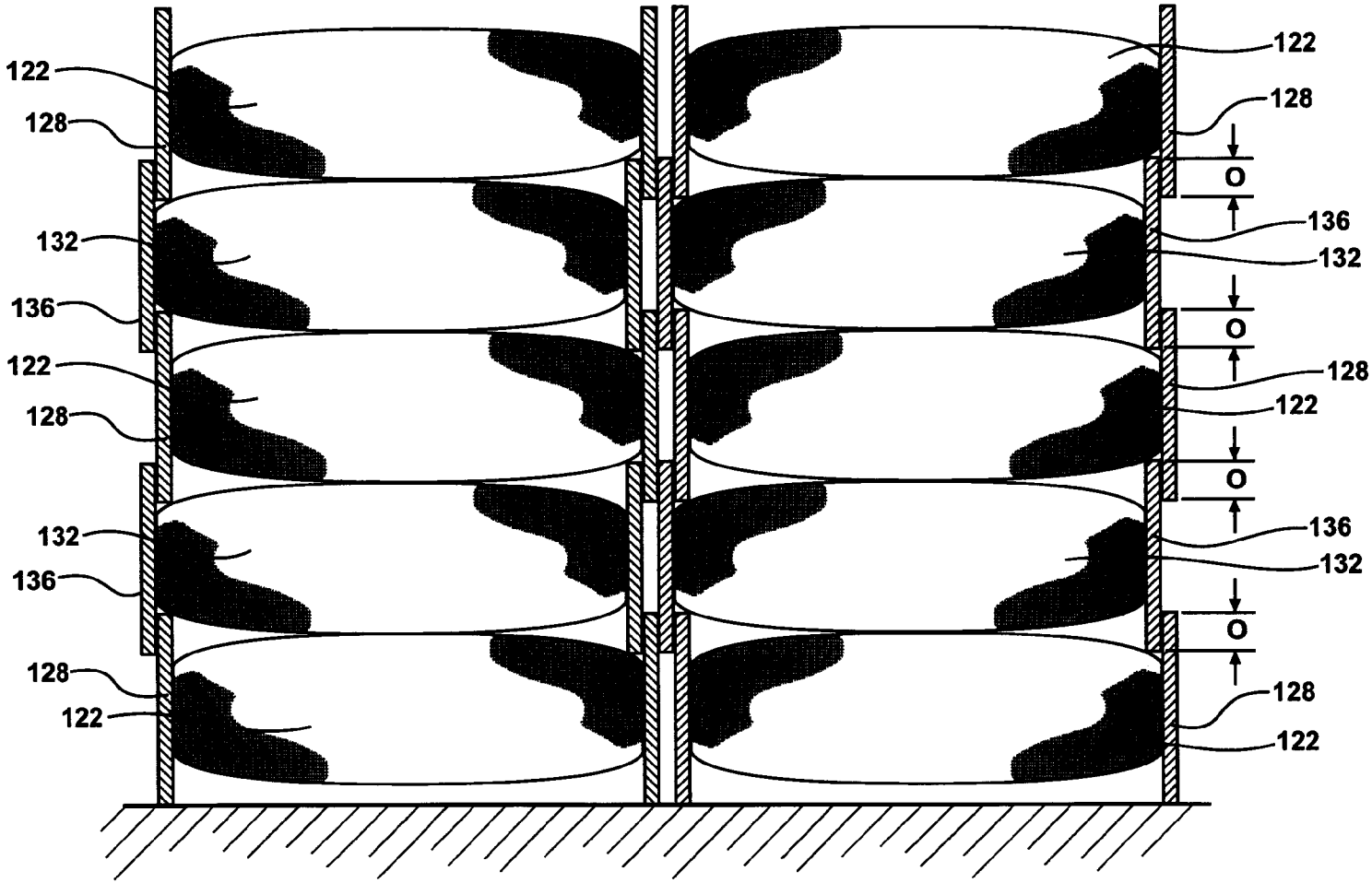
FIG. 9 is a side view of an alternative stacking arrangement of the protective wall assembly.

Referring to FIGS. 6 through 8, the subject invention also includes a protective wall system 120 for protecting against the penetration of a projectile. The protective wall system 120 comprises of a series of the armor plated assemblies 20 stacked in a formation of a wall or structure. The protective wall system 120 incorporates the structure of the above assembly 20 but further includes a mechanical connection to secure a plurality of the above discussed assemblies 20 in a stack orientation or aligned orientation. For simplification, to clearly understand the protective wall system 120 the numbering is starting from 120 in this section. In addition, the description of the protective wall system 120 includes only two assemblies or containers 122, 132 but, as shown in FIGS. 6 and 9, the protective wall system 120 may further include additional assemblies 20 to build a wall of the desired height or desired structure.

The protective wall system 120 includes a first container 122 having opposing walls 124 defining an envelope. The first container 122 is similar to the container 22 previously discussed. As previously discussed, a portion of the envelope is movable between an open position for receiving a protective material and a closed position for encompassing the protective material. A first armor device 126 is at least partially disposed within the first container 122. The first armor device 126 has a first outer plate 128 and a first inner plate 130 with at least one of the opposing walls 124 of the first container 122 being sandwiched between the first outer plate 128 and the first inner plate 130. The first outer and first inner plates 128, 130 provide protection for impeding the penetration of a projectile through the first container 122. It should be appreciated that the first outer plate 128 is equivalent and similar to the first plate 48 and the first inner plate 130 is equivalent and similar to the second plate 50. In additional the protective wall system may include an additional first outer plate 128 equivalent and similar to the third plate 54 and an additional first inner plate 130 equivalent and similar to the fourth plate 56, as shown in FIG. 6. The additional plates 128, 130 are shown in the illustrate embodiment but it should be appreciated by one skilled in the art that the additional plates 128, 130 are added depending on the degree of protection needed for impeding the projectile through the protective wall system 120 for a given application or environment.

The protective wall system 120 further includes a second container 132 having opposing walls 124 defining an envelope. The second container 132 is again similar to the container 22 previously discussed. As previously discussed, a portion of the envelope is movable between an open position for receiving a protective material and a closed position for encompassing the protective material. A second armor device 134 is at least partially disposed within the second container 132. The second armor device 134 has a second outer plate 136 and a second inner plate 138 with one of the opposing walls 124 of the second container 132 being sandwiched between the second inner plate 138 and the second outer plate 136. The second inner and the second outer plates 138, 136 provide protection for impeding the penetration of a projectile through the second container 132. It should be appreciated that the second outer plate 136 is equivalent and similar to the first plate 48 and the second inner plate 138 is equivalent and similar to the second plate 50. In additional the protective wall system may include an additional second outer plate 136 equivalent and similar to the third plate 54 and an additional second inner plate 138 equivalent and similar to the fourth plate 56, as shown in FIG. 6. The additional plates 136, 138 are shown in the illustrate embodiment but it should be appreciated by one skilled in the art that the additional plates 136, 138 are added depending on the degree of protection needed for impeding the projectile through the protective wall system 120 for a given application or environment.

The first and second outer plates 128, 136 define a peripheral edge 137 having a thickness, T. The thickness of the outer plates 128, 136 may vary to provide varying protection scalable for each application and environment.

The protective wall system 120 includes a mechanical connection 140 defined between the first and second outer plates 128, 136 of the first and second armor devices 126, 134 respectively for aligning the first and second containers 122, 132 to build the protective wall system 120. There are several contemplations to allow for the joining of the first and second outer plates 128, 136 to create an interlock between the containers 122, 132, as shown in FIG. 6. The various mechanical connections 140 are shown in FIG. 6 and FIGS. 7A-7D, and one skilled in the art would recognize that there are nearly endless possibilities to join and align the containers 122, 132. As shown in FIG. 7A, a first embodiment of the mechanical connection 140 includes a clip 142 having a base 144 with two pairs of fingers 146 extending in opposite directions from the base 144. Each pair of fingers 146 is biased inward for engaging either the first or second outer plates 128, 136. The clip 142 secures the first and second containers 122, 132 with the base 144 of the clip 142 between the first and second outer plates 128, 136, as shown in the FIGS. 6 and 7A.

Referring now to FIGS. 6 and 7B, a second embodiment of the mechanical connection 140 includes a slot 148 formed in the peripheral edge 137 in both the first and second outer plates 128, 136 and a ridge 150 formed in both the peripheral edge 137 of the first and second outer plates 128, 136. The ridge 150 is spaced from the slot 148 on each of the first and second outer plates 128, 132 and in the illustrated embodiment the ridge 150 and slot 148 are on opposite sides of the first and second outer plates 128, 136. As shown in FIG. 7B, the ridge 150 of the first outer plate 128 engages into the slot 148 of the second outer plate 136 for aligning the first and second containers 122, 132 in a stacked orientation.

Referring to FIGS. 6 and 7C, a third embodiment of the mechanical connection 140 includes at least one hole 152 formed in the peripheral edge 137 of the first and second outer plates 128, 136 and a removable pin 154. As shown in FIG. 7C, the removable pin 154 is disposed into the hole 152 of the first outer plate 128 and a corresponding hole 152 of the second outer plate 136 for aligning and securing the first and second containers 122, 132 in a stacked orientation. The removable pin 154 includes a tapered tip 156 to aid in the alignment of the first and second outer plates 128, 136 during the stacking of the first and second containers 122, 132. In addition as shown in FIG. 7D, it is also contemplated that a post 157 may be fixed on the first and second outer plates 128, 136 and extending from the peripheral edge 137 into the corresponding hole 152 on the opposite side of the post 157 on the first and second outer plates 128, 136.

Referring to FIGS. 6 and 8 the mechanical connection may include at least one tab 158 connected to and extending outwardly from the first and second outer plates 128, 136. The tab 158 defines an aperture 160. The mechanical connection 140 further includes a retention apparatus 162. The retention apparatus 162 includes a C-shaped clasp 164 for saddling engagement with either the first outer plate 128 or the second outer plate 136. The retention apparatus 162 also includes a shaft 166 that connects with the C-shaped clasp 164 and extends parallel with the first and second outer plates 128, 136 through the aperture 160 of the tabs 158 for aligning the first and second containers 122, 132 in a stack orientation.

As shown in FIG. 9, the mechanical connection may also include the first and second outer plates 128, 136 with each of the outer plates 128, 136 defining an overlapping section O. The first and second outer plates 128, 136 are disposed in interleaving side-by-side engagement with the overlapping sections O engaging each other. Optionally, additional rows may be stacked to offer additional protection against the penetration of a projectile through the protective wall system.

Figure 10A:
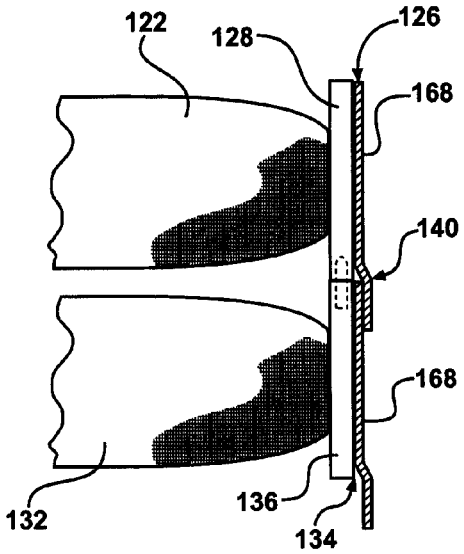
FIG. 10A is a detailed cross-sectional view of the protective wall system with an optional bib.
Figure 10B:
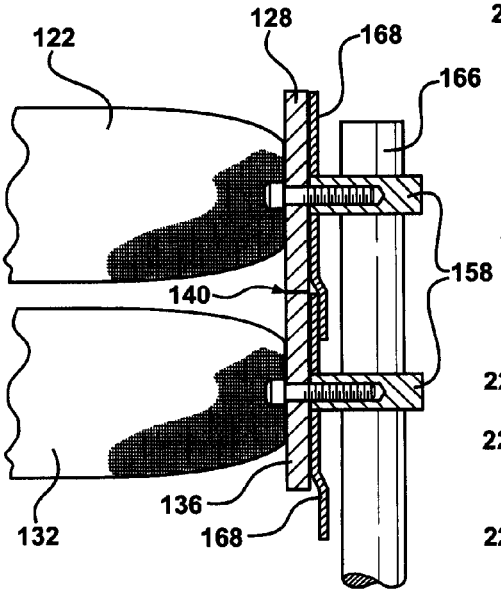
FIG. 10B is a second detailed cross-sectional view of the protective wall system with the optional bib.

As shown in FIGS. 10A and 10B, the first armor device 126 may include a bib 168 optionally adhered to the first outer plate 128. The second armor device 134 may include a bib 168 optionally adhered to the second outer plate 136. The bib 168 of the first armor device 126 extends past the first outer plate 128 on the second outer plate 136 and over the bib 168 of the second armor device 134 at the mechanical connection 140 between the first and second outer plates 128, 136. The bib 168 may be made of a synthetic fiber, an Interceptor® material, manufactured by Point Blank Body Armor Inc. in Pompano, Fla. or a Dragon Skin® material manufactured by Pinnacle Armor in Fresno, Calif. In addition, one skilled in the art would recognize that the bib 168 may be made of any material suitable to provide additional protection to impede the penetration of a projectile through the mechanical connection 140 of the protective wall system 120.

Figure 10C:
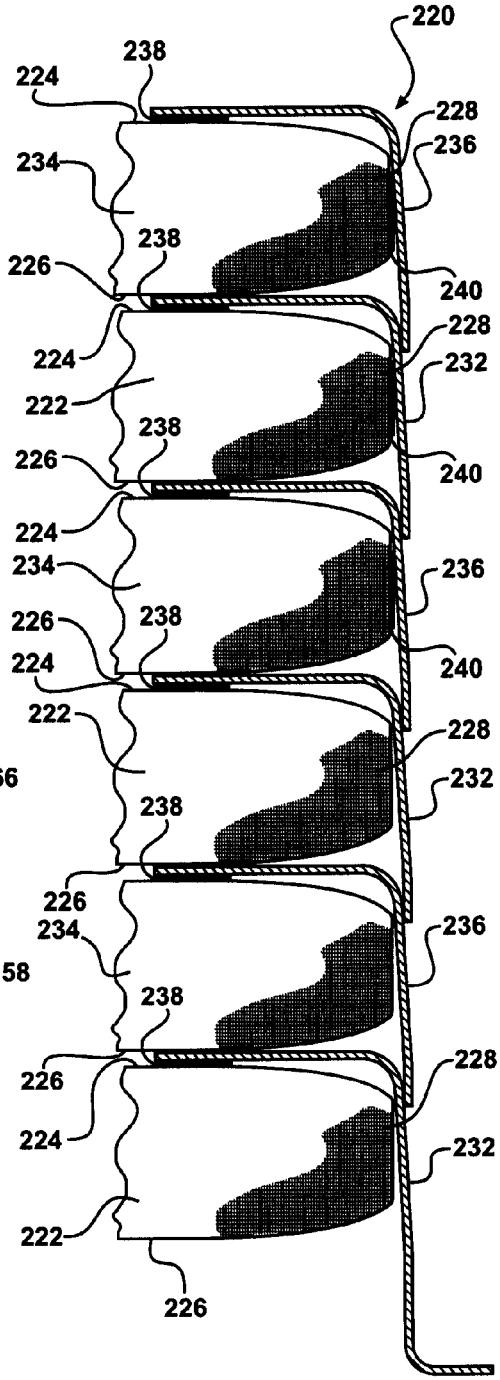
FIG. 10C is a partial side cross-sectional view of a second embodiment of the protective wall system.

As shown in FIG. 10C, is a second embodiment of the protective wall system 220. The second embodiment of the protective wall system 220 comprises of a first container 222 having a top 224, a bottom 226, two opposing side 228 and a base defining an envelope. A portion of the envelope is movable between an open position for receiving the material and a closed position for encompassing the material. A first bib 232 is attached to the top 224 of the first container 222 and extends over one of the opposing sides 228 of the first container 222. The protective wall system 220 includes a second container 234 having a top 224, a bottom 226, two opposing side 228 and a base defining an envelope. A portion of the envelope is movable between an open position for receiving a protective material and a closed position for encompassing the protective material. A second bib 236 is attached to the top of the second container 234 and extends over one of the opposing sides 228 of the second container 234. The first bib 232 overlaps the second bib 236 in a shingle-like engagement for impeding the penetration of a projectile through the armor plated assembly. The first and second bibs 232, 236 are attached to the containers 222, 234 in any suitable manner known to one skilled in the art. In the illustrated embodiment, the bibs 232, 236 are adhered to the containers 222, 234 by a bib fastener 238. The bib fastener 238 may include a two-side tape, a hook and loop fastener, such as Velcro® manufactured by Velcro USA Inc. in Manchester, N.H., or any suitable method as is known in the art. The bibs 232, 236 are made of a synthetic fiber, an Interceptor® material, manufactured by Point Blank Body Armor Inc. in Pompano, Fla. or a Dragon Skin® material manufactured by Pinnacle Armor in Fresno, Calif. It is understood by one skilled in the art that the bibs 232, 236 may be made of various materials that impede the penetration of a projectile into the container 222, 234. Optionally, the second embodiment may further include a second bib fastener 240 for securing the first and second bibs 232, 236 to one of the opposing sides 228 of the first and second containers 222, 234, respectively. The second bib fastener 240 may include a two-side tape, a hook and loop fastener, such as Velcro® manufactured by Velcro USA Inc. in Manchester, N.H., or any suitable method as is known in the art.

The second embodiment may be retrofitted onto an existing protective wall of sandbags or containers 222, 234. The bibs 232, 236 may be retrofitted to the existing protective wall by making the bibs 232, 236 in various geometries to accommodate the various sizes of sandbags or containers 222, 234. The bibs 232, 236 need to be sized to the sandbag or container such that the bibs 232, 236 maintain the shingle-like engagement as shown in FIG. 10C. The bibs 232, 236 may be attached to the existing sandbags or containers 222, 234 in any suitable manner used by one skilled in the art.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed:

1. A protective wall system for protecting against a penetration of a projectile, said protective wall system comprising:

a first armor device having;

a first pair of outer supports spaced a distance apart and supported by at least one first rod extending between said outer supports;

a first outer plate coupled to one of said first outer supports and formed of a material capable of stopping, absorbing or slowing the projectile for impeding the penetration of the projectile through said first armor device;

a second armor device having;

a second pair of outer supports spaced a distance apart and supported by at least one second rod extending between said outer supports;

a second outer plate coupled to one of said second outer supports and formed of a material capable of stopping, absorbing or slowing the projectile for impeding the penetration of the projectile through said second armor device; and a mechanical connection disposed between and directly connected to both of said first outer plate and said second outer plate to mechanically join and align said first and second armor devices to each other to stackably connect said first and second armor devices to each other and define said protective wall system.

2. A system as set forth in claim 1 wherein said mechanical connection includes a clip having a base with two pairs of fingers extending in opposite directions from said base and each pair of fingers biased inward for engaging said first and second outer plates.

3. A system as set forth in claim 1 wherein each of said first and second outer plates define a peripheral edge having a thickness.

4. A system as set forth in claim 3 wherein said mechanical connection includes a slot formed in said peripheral edge of both of said first and second outer plates and a ridge formed in said peripheral edge of both of said first and second outer plates and said ridge spaced from said slot with said ridge of said first outer plate engaging said slot of said second outer plate.

5. A system as set forth in claim 3 wherein said mechanical connection includes at least one hole formed in said peripheral edge of both of said first and second outer plates and a removable pin disposed in said hole of said first outer plate and a corresponding hole of said second outer plate.

6. A system as set forth in claim 1 wherein said mechanical connection includes said first and second outer plates with each of said outer plates defining an overlapping section and said first and second outer plates disposed in interleaving side-by-side engagement with said overlapping sections engaging each other.

7. A system as set forth in claim 1 further including;

another first outer plate coupled to the other of said first outer supports, and another second outer plate coupled to the other of said second outer supports, wherein;

another mechanical connection is disposed between each of said another first outer plates and each of said another second outer plates to further mechanically join and align said first and second armor devices.

8. A system as set forth in claim 7 wherein;

said first armor device further includes a first inner plate mounted to each of said first outer plates and coupled to each of said first outer supports, and said second armor device further includes a second inner plate mounted to each of said second outer plates and coupled to each of said second outer supports.

9. A system as set forth in claim 1 wherein;

said first armor device further includes a first inner plate mounted to said first outer plate and coupled to one of said first outer supports for further impeding the penetration of the projectile, and said second armor device further includes a second inner plate mounted to said second outer plate and coupled to one of said second outer supports for further impeding the penetration of the projectile.

10. A system as set forth in claim 9 wherein;

said first armor device further includes a plurality of first fasteners mounting said first inner plate to said first outer plate, and said second armor device further includes a plurality of second fasteners mounting said second inner plate to said second outer plate.

11. A system as set forth in claim 1 wherein;

said first outer plate is elongated and dimensionally larger than each of said first outer supports, and said second outer plate is elongated and dimensionally larger than each of said second outer supports.

12. A system as set forth in claim 1 wherein;

said first pair of outer supports and said first rod define a first insert apparatus, and said second pair of outer supports and said second rod define a second insert apparatus, and further including;

a first container having first opposing walls defining a first envelope with a portion of said first envelope movable to an open position to receive said first insert apparatus and dispose said first insert apparatus within said first walls of said first container, and said first outer plate disposed outside of said first container, and a second container having second opposing walls defining a second envelope with a portion of said second envelope movable to an open position to receive said second insert apparatus and dispose said second insert apparatus within said second walls of said second container, and said second outer plate disposed outside of said second container.

13. A system as set forth in claim 12 wherein;

said first outer plate is elongated and dimensionally larger than each of said first outer supports, and said second outer plate is elongated and dimensionally larger than each of said second outer supports.

14. A protective wall system for protecting against a penetration of a projectile, said protective wall system comprising:

a first armor device having;

a first pair of outer supports spaced a distance apart and supported by at least one first rod extending between said outer supports;

a first outer plate coupled to one of said first outer supports and formed of a material capable of stopping, absorbing or slowing the projectile for impeding the penetration of the projectile through said first armor device;

a second armor device having;

a second pair of outer supports spaced a distance apart and supported by at least one second rod extending between said outer supports;

a second outer plate coupled to one of said second outer supports and formed of a material capable of stopping, absorbing or slowing the projectile for impeding the penetration of the projectile through said second armor device; and a mechanical connection having at least one tab connected to and extending outwardly from said first and second outer plates with said tab defining an aperture through said tab to mechanically join and align said first and second armor devices to stackably connect said first and second armor devices and define said protective wall system.

15. A system as set forth in claim 14 wherein said mechanical connection further includes a retention apparatus having a clasp for saddling engagement with one of said first and second outer plates and a shaft extending through said apertures of said tabs on said first plates.

16. A protective wall system for protecting against a penetration of a projectile, said protective wall system comprising:

a first armor device having;

a first pair of outer supports spaced a distance apart and supported by at least one first rod extending between said outer supports;

a first outer plate coupled to one of said first outer supports and formed of a material capable of stopping, absorbing or slowing the projectile for impeding the penetration of the projectile through said first armor device;

a second armor device having;

a second pair of outer supports spaced a distance apart and supported by at least one second rod extending between said outer supports;

a second outer plate coupled to one of said second outer supports and formed of a material capable of stopping, absorbing or slowing the projectile for impeding the penetration of the projectile through said second armor device; and a mechanical connection disposed between said first outer plate and said second outer plate to mechanically join and align said first and second armor devices to stackably connect said first and second armor devices and define said protective wall system, wherein said first armor device further includes a bib adhered to said first outer plate, and said second armor device further includes a bib adhered to said second outer plate with said bib of said first armor device extending past said first outer plate onto said second outer plate and over said bib of said second armor device at said mechanical connection between said first and second outer plates.

* * * * *